United States Patent [19]

Ellis

[11] 4,282,810

[45] Aug. 11, 1981

[54] PRINT ROLLER

[76] Inventor: James F. Ellis, Box 100B Chandler Rd., LaFayette, Ga. 30728

[21] Appl. No.: 43,432

[22] Filed: Jun. 11, 1979

[51] Int. Cl.[3] ..... B41F 27/00

[52] U.S. Cl. ..... 101/376; 101/382 R; 101/373; 101/153; 101/401

[58] Field of Search ..... 101/375, 376, 378, 382 R, 101/383, 382 MV, 373, 401, 401.1, 328, 150, 153, 395, 372

[56] References Cited

U.S. PATENT DOCUMENTS

| | | | |
|---|---|---|---|
| 3,068,789 | 12/1962 | D'Alcantara | 101/375 |
| 3,106,891 | 10/1963 | James | 101/376 |
| 3,146,709 | 9/1964 | Bass et al. | 101/375 |
| 3,193,435 | 7/1965 | Schafer | 101/395 X |
| 3,213,788 | 10/1965 | Braznell et al. | 101/395 X |
| 3,378,902 | 4/1968 | Hoexter | 101/375 X |
| 3,662,050 | 5/1972 | Willett | 101/395 X |
| 3,705,072 | 12/1972 | Rosvold | 101/401.1 |
| 4,007,680 | 2/1977 | Pfleger et al. | 101/153 |
| 4,056,057 | 11/1977 | Smith | 101/382 MV |
| 4,144,812 | 3/1979 | Julian | 101/382 R |

FOREIGN PATENT DOCUMENTS

| | | | |
|---|---|---|---|
| 1188996 | 9/1959 | France | 101/376 |

*Primary Examiner*—E. H. Eickholt

*Attorney, Agent, or Firm*—Dunlap, Codding & McCarthy

[57] ABSTRACT

An improved print roller for applying dye to a textile material in a predetermined pattern is provided wherein the core of the roller, which is operatively supported in a rotatable position by a shaft, is encapsulated with a cover formed of a substantially impervious elastomeric material. Dye applicators are then bonded to the cover.

7 Claims, 7 Drawing Figures

PRINT ROLLER

BACKGROUND OF THE INVENTION

1. Field of the Invention

This invention relates to an improved print roller for applying dye to a textile material in a predetermined pattern. In another aspect, the invention relates to an improved print roller wherein the body member of the roller is encapsulated with a cover formed of a substantially impervious elastomeric material and the dye applicators are bonded to the cover.

2. Description of the Prior Art

Numerous processes and apparatus have been employed by the textile industry in the pattern printing of textile materials. In recent years many advances have been made in the pattern printing of textile materials, such as through the use of computerized jet dyeing processes and apparatus, improved screen printing techniques and apparatus, and the like.

An early form of pattern printing of a textile material employed a print roller to transfer the dye to the textile material. Equipment of this type is still employed by the smaller textile manufacturers and/or dyers because the smaller firms cannot afford the more sophisticated equipment which has become available to the larger manufacturers. Problems have, nevertheless, been encountered in the pattern printing of textile materials using print rollers because the rollers heretofore known have been constructed with plywood disc covers so that the dye applicators could be secured thereto by the use of nails.

In employing the prior art print rollers in a dyeing process at least a portion of the roller is submerged in the dye tray so that the dye applicators can pick up a sufficient amount of the dye and transfer it to the textile material. Since a portion of the plywood disc covers are in contact with the liquid dye admixture the plywood discs also absorb a portion of the liquid dye mixture which results in the discs swelling and thus a loosening of the dye applicators. In addition, the absorbtion of liquid from the dye admixture by the laminated plywood discs cause the print roller to gain weight which results in deflection of the roller and thus improper printing of the textile material.

Therefore, a need has long been recognized for an improved print roller for use in the pattern printing of textile materials. However, even though the need has long been recognized, until the present invention, no suitable alternative for the laminated plywood print roller has heretofore been known.

Therefore, an object of the present invention is to provide an improved print roller for applying dye to a textile material which substantially eliminates the before mentioned problems of the prior art.

Another object of the invention is to provide an improved print roller for applying dye to a textile material which is economical to manufacture, relatively simple in construction, and which substantially improves the definition of the pattern resulting from the application of the dye to the textile material.

These and other objects, advantages and features of the present invention will become apparent to those skilled in the art from a reading of the following detailed description when read in conjunction with the accompanying drawings which illustrate the invention.

DETAILED DESCRIPTION OF THE INVENTION

Figure 1:
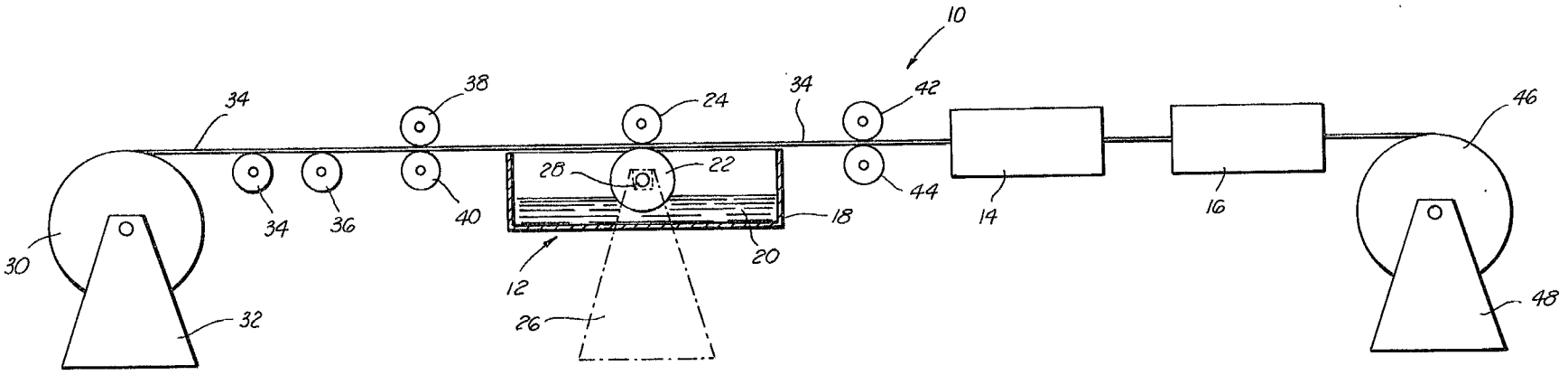
FIG. 1 is a simplified schematic representation of a dye range of a textile dyeing house employing the improved print roller of the present invention.

Referring now to the drawings in which like numerals are employed to designate like parts throughout same, and particularly to FIG. 1, a schematic representation of a simplified dye range 10 is set forth. Broadly speaking, the dye range 10 comprises a dyeing apparatus 12, a steamer 14, and a dryer 16. The dyeing apparatus 12 includes a dye tray 18 having a liquid dye admixture 20 therein, a print roller 22, and a press roll or backing roll 24. The print roller 22 is rotatably positioned within the dye tray 18 so that the lower portion of the print roller 22 is immersed within the liquid dye admixture 20 in the dye tray 18. The press roll or backing roll 24 is rotatably positioned in close proximity to the print roller 22 so that as a textile material is passed between the print roller 22 and the press or backing roll 24 the print roller can apply the dye to the textile material at a sufficient pressure to assure transfer of the dye from the print roller 22 to the textile material. The print roller is rotatably positioned in the dye tray 18 by any suitable means, such as support assembly 26, and the print roller 22 is rotatably driven by a driving assembly such as motor 28. The backing or press roll 24, which is rotated in a clockwise direction, and thus opposite the counterclockwise rotation of the print roller 22, may be driven in any suitable manner known in the art and the cooperation between the press or backing roll 24 and the print roller 22 help advance the material therethrough.

In the dyeing of a textile material employing the dyeing apparatus 10 described above, a roll of textile material 30 is rotatably supported by a support assembly 32. Textile material 34 is withdrawn from the roll of textile material 30 and advanced over support rollers 34 and 36, between a series of nip rollers, such as nip rollers 38 and 40, and into the dyeing apparatus 12. The dyed textile material 34' is withdrawn from the dyeing apparatus 12 and passed through a second series of nip rollers, such as nip rollers 42 and 44 and passed through the steamer 14 and the dryer 16 so that the dye is set and affixed to the textile material. The substantially dry, dyed textile material, is then passed from the dryer 16 to a takeup roll 46. The takeup roll 46 is rotatably supported by a support assembly 48. The nip rollers 38, 40, 42 and 44, as well as the takeup roll 46, may be driven in any suitable manner known to the art to cause the textile material to advance through the dye range 10.

Figure 2:
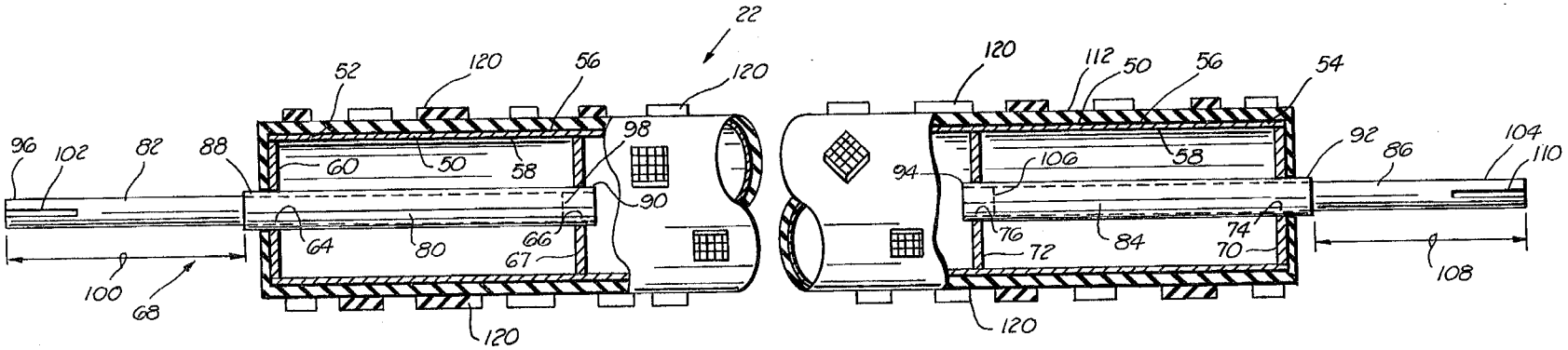
FIG. 2 is a partially broken side elevational view of the improved print roller of the present invention.
Figure 3:
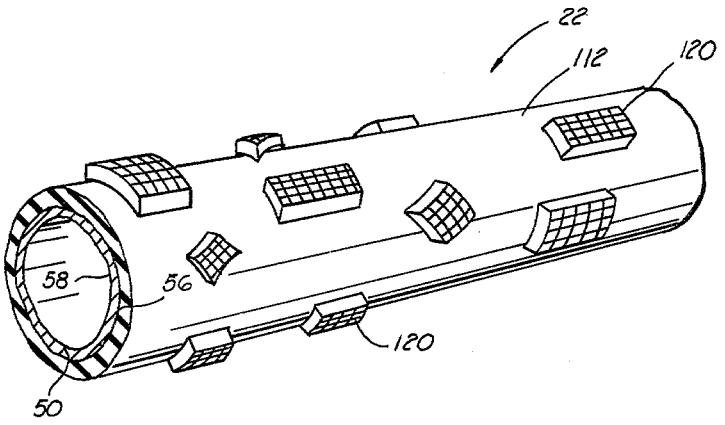
FIG. 3 is a partially broken perspective view of the print roller of the present invention illustrating dye applicators having an embossed printing surface.

Referring now to FIGS. 2 and 3, the print roller 22 of the subject invention is illustrated in more detail. The print roller 22 comprises a body member 50 having a first end 52 and an opposed second end 54. The body member 50, a hollow cylindrical member, is provided with a generally smooth cylindrical exterior surface 56 and an opposed cylindrical interior surface 58. A first end plate 60 is positioned within the first end 52 of the body member 50 and secured to the interior surface 58 of the body member 50 by any suitable means, such as welding. A first support member 62 is positioned within the body member 50 so as to be in a substantially parallel spatial relationship with respect to the first end member 60. The first support member 62 is secured to the interior surface 58 of the body member 50 by any suitable means, such as welding. The first end plate 60 is provided with a centrally disposed bore 64 extending therethrough; and the first support member 62 is provided with a centrally disposed bore 66 extending therethrough. The centrally disposed bores 64 and 66 of the first end plate 60 and the first support member 62, respectively, are axially aligned so that shaft assembly 68 can be positioned therein and secured thereto.

A second end plate 70 is positioned within the opposed second end 54 of the body member 50 and secured to the interior surface 58 of the body member 50 by any suitable means, such as welding. A second support member 72 is positioned within the body member 50 so as to be in a substantially parallel, spatial relationship with respect to the second end plate 70. The second support member 72 is secured to the interior surface 58 of the body member 50 by any suitable means, such as welding.

The second end plate 70 is provided with a centrally disposed bore 74 extending therethrough; and the second support member 72 is provided with a centrally disposed bore 76 extending therethrough. The centrally disposed bores 74 and 76 of the second end plate 70 and the second support member 72, respectfully, are axially aligned so that the shaft assembly 68 can be positioned therein and secured thereto.

The shaft assembly 68 can extend throughout the length of the body member 50 or can be formed of a number of components. As shown in FIG. 2, the shaft assembly 68 comprises a first tubular sleeve 80, a first shaft member 82, a second tubular sleeve 84 and a second shaft member 86.

The first tubular sleeve 80, is provided with a first end 88 and an opposed second end 90. The first tubular sleeve 80 is positioned within the aligned bores 64 and 66 of the first end plate 60 and the first support member 62, respectively, so that the first end 88 thereof extends outwardly a distance from the first end plate 60, and the second opposed end 90 extends inwardly into the interior portion of the body member 50 a distance beyond the first support member 62.

The second tubular sleeve 84, is also provided with a first end 92 and an opposed second end 94. The second tubular sleeve 84 is positioned within the aligned bores 74 and 76 of the second end plate 70 and the second support member 72, respectively, so that the first end portion 92 thereof extends outwardly a distance from the second end plate 70 and the opposed second end 94 extends inwardly into the interior portion of the body member 50 a distance beyond the second support member 72.

The first shaft member 82 is provided with a first end 96 and an opposed second end 98 (shown in phantom). The opposed second end 98 is positioned within the first tubular sleeve 80 and secured therein so that the first end 96 of the first shaft member 82 extends a distance 100 from the first end 88 of the first tubular sleeve 80. The first end 98 of the first shaft member 82 is provided with a yoke 102 for operatively connecting the first shaft member 82, and thus the body member 50, to the support assembly 26 and the motor 28 (shown in FIG. 1) which operatively support and rotate the print roller 22.

The second shaft member 86 is provided with a first end 104 and an opposed second end 106 (shown in phantom). The opposed second end 106 is positioned within the second tubular sleeve 86 and secured therein so that the outwardly extending first end 104 of the second shaft member 84 extends a distance 108 from the first end 92 of the second tubular sleeve 86. The first end 104 of the second shaft member 84 is provided with a yoke 110 for operatively connecting the second shaft member 84 to a support, and if applicable, a motor, which operatively rotates the print roller 22 and maintains it in an operative position.

The body member 50, and the first and second end plate 60 and 70, respectively, are incapsulated with a cover 112 formed of a substantially impervious elastomeric material. The cover 112 is securely affixed to the cylindrical exterior surface 56 of the body member 50 so that slippage or movement of the cover 112 is prevented when the print roller 22 is in use. The term impervious, elastomeric material as used herein is to be understood to encompass a material which is not penetrated by the components of the liquid dye mixture employed in the dying process and has resilient properties. Thus, the chemical nature of the substantially impervious elastomeric material employed as the cover 112 can vary widely and will be dependant to a large degree upon the chemical nature of the dye bath. In other words, the material possesses rubber-like characteristics which renders the material capable of being compressed when the print roller is contacted with the textile material and the press or backing roll and returns to a normal uncompressed state when no longer in contact with the textile material and the press or backing roll. Typical of such materials meeting the above definition which can be employed as the cover 112 or the press roller 24 are polymerization products resulting from the polymerization of both natural occurring and synthetically derived monomers. Representative of such polymerization products are the synthetic rubbers, such as polybtadiene, isoprene, neoprene, and the like; natural rubber, and polyofelins, such as polyethylene, polypropylene, and the like. In addition, other types of polymerization products, such as a silicone rubber, can be employed.

As previously stated, the cover 112 employed to incapsulate the body member 150 and the first and second end plates 60 and 70 is securely affixed to the exterior surface 56 of the body member 50 so that the cover does not slip or slide when the body member 50 is caused to rotate. The method employed to affix the cover member 112 to the body member 50 will vary and be dependent to a large degree upon the particular type of material employed to produce the impervious, elastomeric cover 112. For example, when a synthetic rubber, such as neoprene, is employed to form the cover 112, the synthetic rubber can be secured to the exterior surface 56 of the body member 50 by vulcanization techniques which are well known in the art.

When other materials are employed to form the cover 112 of the print roller 22, adhesives and other bonding techniques for securing the cover 112 to the exterior surface 56 of the body member 50 can be employed. Once the cover 112 has been securely affixed to the exterior surface 56 of the print roller 22, at least one dye applicator 120 is secured to the cover 120. The dye applicator 120 is fabricated of a material which is compatible with the cover 112 so that the dye applicator 120 can be securely bonded to the cover 112 by any suitable means, such as vulcanization, the use of adhesives, and the like. Generally, a plurality of the dye applicators 120 will be secured to the cover 112 in a predetermined pattern.

Figure 4:
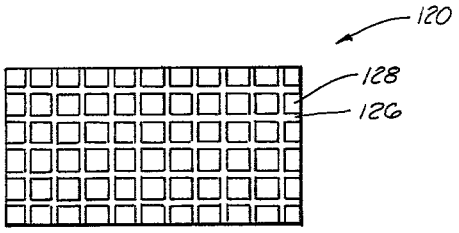
FIG. 4 is a top plan view of one of the dye applicators of FIG. 3.
Figure 5:
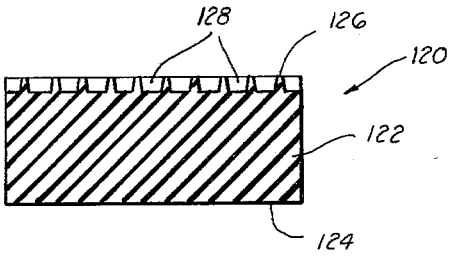
FIG. 5 is a side elevational view, in cross section, of the dye applicator of FIG. 4 taken along the line 5—5.

Referring now to FIGS. 4 and 5, one embodiment of the dye applicator 120 is depicted. In this embodiment the dye applicator 120 is fabricated of a substantially impervious elastomeric material, (the term impervious elastomeric material being heretofore defined). The dye applicator 120 is provided with a body portion 122 having a first side 124 and an opposed second side 126. The dye applicator 120 is secured to the cover 112 through the first side 124 by any suitable means, such as vulcanization, or the use of an adhesive. For example, when the dye applicator 120 and the cover 112 are fabricated from a synthetic rubber, such as neoprene, the dye applicator 120 can be secured to the cover 112 by the use of a water-insoluble, solvent-resistent, pressure sensitive adhesive, such as cyanoacrylate adhesive manufactured and marketed by Loctite Canada, Ltd. under the trademark "Super Bonder". The opposed second side 126 of the body portion 122 of the dye applicator 120 is provided with a dye application surface 128. The dye application surface 128 of the dye applicator 120 of this embodiment is an embossed surface. By constructing the dye applicator 120 with an embossed dye application surface 128, the problem of loss of the dye application surface 128 due to friction between, or entanglement with, the fibers of the textile material being dyed and the dye application surface 128 of the dye applicator 120 during the dyeing process is substantially eliminated. It should be noted that while the dye application surface 128 of the dye applicator 120 is depicted as a plurality of individual segments having a substantially square shaped configuration, any suitable configuration can be employed and the particular configuration chosen for the dye application surface 128 of the dye applicator 120 will be dependent upon the pattern desired to be applied to the textile material, the characteristics of the textile material, and the properties of the dye being applied to the textile material.

Figure 6:
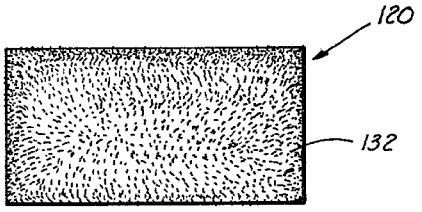
FIG. 6 is a top plan view of a second embodiment of a dye applicator of the print roller of the present invention.
Figure 7:
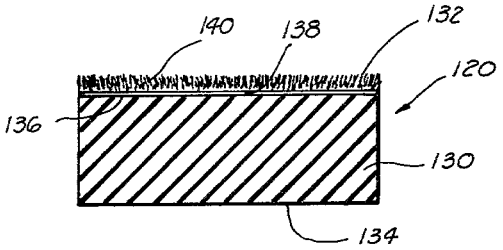
FIG. 7 is a side elevational view, in cross section, of the dye applicator of FIG. 6 taken along the line 7—7.

Referring now to FIGS. 6 and 7, a second embodiment of the dye applicator 120 is depicted. In this embodiment, the dye applicator 120 includes a body member 130 and a dye applicator member 132. The body member 130 is provided with a first side 135 and an opposed second side 136; and the dye applicator member 132 is provided with a first side 138 and an opposed dye application side 140. The body member 130 of the dye applicator 120 is secured to the cover 112 of the print roller through the first side 134 by any suitable means, such as vulcanization or the use of an adhesive. For example, when the body member 130 of the dye applicator 120 is fabricated from a synthetic rubber, such as neoprene, the body member 130 can be secured to the cover 112 by the use of a water-insoluble, solvent-resistent, pressure sensitive adhesive such as the cyanoacrylate adhesive hereinbefore set forth.

The first side 138 of the dye applicator member 132 is bonded and secured to the second opposed side 136 of the body member 130 so that the dye application side 140 of the dye applicator member 132 extends outwardly from the body member 130. The dye application side 140 of the dye applicator member 132 is depicted as a plurality of fibers. The bonding of the dye applicator member 132 to the body member 130 of the dye applicator 120 can be achieved by any suitable means, such as by the use of adhesives which are well known in the art. However, the adhesive chosen to bond the dye applicator member 132 to the body member 130 must be compatible both with the materials employed to fabricate the body member 130 and the dye applicator member 132.

The dye applicator member 132 can be formed of any suitable material, such as felt, or the like, which is capable of absorbing the dye from the liquid dye admixture and transferring the dye to the textile material being contacted with the dye applicator 120 during the dyeing process.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as is specified in the appended claims.

What is claimed is:

1. An improved print roller for applying a dyestuff to a textile substrate which comprises:

a hollow cylindrical body member having a first end, an opposed second end, a generally smooth cylindrical exterior surface and a cylindrical interior surface;

a first end plate secured to the first end of the hollow cylindrical body member, the first end plate having a substantially centrally disposed aperture therein;

a second end plate secured to the opposed second end of the hollow cylindrical body member, the second end plate having a substantially centrally disposed aperture therein;

a plurality of support members fixably disposed within the hollow cylindrical body member, the support members having an aperture therein which is aligned with the apertures in the first and second end plates;

a first shaft having a first end portion and an opposed second end portion, the opposed second end portion of the first shaft being disposed within the apertures of the first end plate and at least one support member and secured thereto such that the first end portion of the first shaft extends outwardly from the first end plate along the central longitudinal axis of the hollow cylindrical body member;

a second shaft having a first end portion and an opposed second end portion, the first end portion of the second shaft being disposed within the apertures of the second end plate and at least one support member and secured thereto such that the opposed second end portion of the second shaft extends outwardly from the second end plate along the central longitudinal axis of the hollow cylindrical body member, at least one of the first end portion of the first shaft and the opposed second end portion of the second shaft operably connectable to a driving means for rotating the hollow cylindrical body member;

a first tubular sleeve disposed upon and affixed to the opposed second end portion of the first shaft;

a second tubular sleeve disposed upon and affixed to the first end portion of the second shaft;

cover means securely affixed to the generally smooth cylindrical exterior surface of the hollow cylindrical body member for encapsulating same, said cover means being formed of a substantially impervious elastomeric material; and at least one dye applicator having a first side and an opposed second side, the applicator being fixably mounted to the cover means on its first side, the opposed second side having a dyestuff carrying surface.

2. The improved print roller according to claim 1 wherein the outwardly extending first end portion of said first shaft and the outwardly extending opposed second end portion of said second shaft each terminate with a yoke.

3. The improved print roller according to claim 1 wherein said dye applicator is formed of a substantially impervious elastomeric material and said second side of said applicator is provided with an embossed surface capable of withdrawing dyestuff from a dye bath and transferring it to the textile substrate.

4. The improved print roller according to claim 3 wherein a plurality of said dyestuff applicators are secured to said cover means in a predetermined spatial relationship.

5. The improved print roller according to claim 4 wherein said cover means and said dye applicator are formed of a synthetic rubber material.

6. The improved print roller according to claim 5 wherein said dye applicator is securely affixed to said cover means by a water insoluble, solvent resistant, pressure sensitive adhesive.

7. The improved print roller according to claim 1 wherein said dye applicator comprises:

an applicator body member formed of a substantially impervious elastomeric material and having a first side and an opposed second side; and a textile substrate securely affixed to said second opposed side of said applicator body member so that a plurality of fiber elements protrude therefrom.

* * * * *